US006862421B2

(12) United States Patent
Choi

(10) Patent No.: US 6,862,421 B2
(45) Date of Patent: Mar. 1, 2005

(54) TRANSFERRING APPARATUS OF COLOR LASER PRINTER

(75) Inventor: Jae-myoung Choi, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/453,614

(22) Filed: Jun. 4, 2003

(65) Prior Publication Data

US 2004/0013452 A1 Jan. 22, 2004

(30) Foreign Application Priority Data

Jul. 22, 2002 (KR) ..... 10-2002-0043012

(51) Int. Cl.[7] ..... G03G 15/00; G03G 15/16

(52) U.S. Cl. ..... 399/302; 399/308; 399/313; 399/317

(58) Field of Search ..... 399/302, 308, 399/303, 313, 317, 121, 124, 21

(56) References Cited

U.S. PATENT DOCUMENTS 4,431,301 A * 2/1984 Hashimoto et al. ..... 399/313 X
5,983,062 A * 11/1999 Sameshima ..... 399/302
6,408,158 B1 * 6/2002 Takahata et al. ..... 399/302
2002/0102110 A1 * 8/2002 Kida ..... 399/124

FOREIGN PATENT DOCUMENTS

JP 2001-356619 * 12/2001
JP 2002-214943 * 7/2002

* cited by examiner

*Primary Examiner*—Sophia S. Chen
(74) *Attorney, Agent, or Firm*—Staas & Halsey LLP

(57) ABSTRACT

An apparatus to transfer a color laser image including an intermediate transfer belt around a plurality of guide rollers provided in a printer body frame; a transfer roller to contact the intermediate transfer belt with a transfer nip, and to transfer the color image of the intermediate transfer belt to a printing paper; a transfer panel, positioned to open and close with respect to the printer body frame, to support the transfer roller; a separating unit to separate the transfer roller from the intermediate transfer belt at constant intervals or pressurize the transfer roller to contact the intermediate transfer belt; and an aligning unit to align the transfer roller with respect to the intermediate transfer belt in the printer body frame. The positions of the central axis of the intermediate transfer belt and the axis of the transfer roller are controlled at the same level on the printer body frame.

12 Claims, 7 Drawing Sheets

TRANSFERRING APPARATUS OF COLOR LASER PRINTER

CROSS-REFERENCE TO RELATED APPLICATIONS

This application claims the benefit of Korean Application No. 2002-43012, filed Jul. 22, 2002, in the Korean Intellectual Property Office, the disclosure of which is incorporated herein by reference.

BACKGROUND OF THE INVENTION

1. Field of the Invention

The present invention generally relates to a color laser printer using an electro-photographic method, and more specifically, to an apparatus to transfer a visible image onto printing paper by a toner formed on a photosensitive medium.

2. Description of the Related Art

A conventional color laser printer using an electro-photographic method develops an electrostatic latent image formed on a photosensitive medium according to an image signal to a visible color image using toners of yellow, magenta, cyan and black. Then, the color laser printer using the electro-photographic method transfers and prints the color image onto the printing paper using a transferring apparatus.

The above-mentioned transferring apparatus includes an intermediate transfer belt 10, a transfer roller 20 and a transfer roller separating/pressurizing unit 30, as illustrated in FIGS. 1, 2A and 2B.

The intermediate transfer belt 10 is provided to travel along a loop, the intermediate transfer belt 10 being wound about a plurality of guide rollers 11–15 disposed on a printer body frame (not shown). The intermediate transfer belt 10 is connected to a photosensitive drum 1 as a photosensitive medium by the guide roller 12, and thereby a toner image of the photosensitive drum 1 is transferred to the intermediate transfer belt 10.

The transfer roller 20 is provided to selectively contact the guide roller 14 with the intermediate transfer belt 10 therebetween. Accordingly, the toner image transferred to the intermediate transfer belt 10 is transferred to printing paper P passing between the intermediate transfer belt 10 and the transfer roller 20. Further, the transfer roller 20 is supported by a transfer panel 2 that is capable of pivoting to open and close the printer body frame. As a result, in the event that the paper P is jammed in a paper path between the intermediate transfer belt 10 and the transfer roller 20, it is possible to easily remove the jammed paper by opening the transfer panel 2 from the printer body frame.

The transfer roller separating/pressurizing unit 30 separates or contacts the transfer roller 20 and the intermediate transfer belt 10. Here, in the case of separating the transfer roller 20 and the intermediate transfer belt 10, the toner image of the photosensitive drum 1 is transferred to the intermediate transfer belt 10. In the case of pressurizing and contacting the transfer roller 20 and the intermediate transfer belt 10, the toner image of the intermediate transfer belt 10 is transferred to the printing paper P. In the color laser printer, the intermediate transfer belt 10 rotates four times to form one color image. Therefore, while the intermediate transfer belt 10 makes four revolutions, the transfer roller 20 and the intermediate transfer belt 10 must be separated from each other, and for this reason, the transfer roller separating/pressurizing unit 30 is required.

The transfer roller separating/pressurizing unit 30 includes a cam unit having a pressurizing block 31 to support the transfer roller 20 to be rotatable, a separating lever 32, of which one end is connected to the pressurizing block 31 and the other end is rotatably positioned by a hinge 32*a* on the printer body frame, and a tension coil spring 33 to elastically support the separating lever 32 in a counter-clockwise direction to maintain a separation state of the transfer roller 20 and the intermediate transfer belt 10, as shown in FIGS. 2A and 2B. The tension coil spring 33 is positioned between the separating lever 32 and the transfer panel 2. The separating/pressurizing unit 30 further includes a cam 34 to contact the transfer roller 20 against the intermediate transfer belt 10 by rotating the separating lever 32 clockwise; and a pair of compression coil springs 35 being provided between an axis of the transfer roller 20 and the pressurizing block 31 to elastically support the transfer roller 20 to the side of the intermediate transfer belt 10, to form a constant transfer nip therebetween when pressurizing the transfer roller 20 with the cam unit.

In the transferring apparatus of the general color laser printer described above, when the toner image of the photosensitive drum 1 is transferred to the intermediate transfer belt 10, the cam 34 is positioned as shown in FIG. 2B. The separating lever 32 is rotated counter-clockwise about the hinge 32*a* at a predetermined angle by the recovery force of the tension coil spring 33 and this enables the transfer roller 20 and the intermediate transfer belt 10 to be separated at constant intervals.

Furthermore, at the point that the transfer of the toner image of the intermediate transfer belt 10 is completed, the cam 34 is positioned as shown in FIG. 2A. Here, the separating lever 32 is rotated clockwise around the hinge 32*a* at a predetermined angle by overcoming the recovery force of the tension coil spring 33, thereby maintaining the state that the transfer roller 20 and the intermediate transfer belt 10 closely contact each other. While the transfer roller 20 is regularly pressed against the intermediate transfer belt 10 by the recovery force of the compression coil spring 35, a transfer nip is formed.

Then, the paper P is fed between the closely contacted transfer roller 20 and the intermediate transfer belt 10 and the toner image transferred to the intermediate transfer belt 10 is transferred to the paper P.

In the transfer process as described above, the transfer nip between the transfer roller 20 and the intermediate transfer belt 10 must be evenly maintained because this nip greatly affects the quality of an image.

Furthermore, the transferring apparatus of the color laser printer as described above is installed on the transfer panel 2 which is capable of pivoting to open and close the printer body frame to remove the paper jammed between the transfer roller 20 and the intermediate transfer belt 10. Therefore, when mounting the transferring apparatus after opening and closing the transfer panel 2, the position of the transfer roller 20 with respect to the intermediate transfer belt 10 is changed and thus the required transfer nip is frequently not formed.

More specifically, as illustrated in FIG. 1, the transfer roller 20 has degrees of freedom in X, Y and Z axis directions with respect to the intermediate transfer belt 10. The degree of freedom in the Z axis direction is compensated for since the length of the transfer roller 20 is longer than that of the paper. The degree of freedom in the X axis direction is compensated for by correcting the recovery force of the compression coil spring 35. However, as to the degree of freedom in the Y axis direction, there occurs a case in which the intermediate transfer belt 10 is not exactly identical with the transfer roller 20. This is because the position of the intermediate transfer belt 10 is determined in the printer body frame while the Y axis direction position of the transfer roller 20 is determined in a different unit (the transfer panel 2), being assembled with the hinge 32.

Therefore, in the conventional transferring apparatus, since the degree of freedom in the Y axis direction of the transfer roller 20 with respect to the intermediate transfer belt 10 is not properly restricted, it is impossible to maintain an even transfer nip and problems such as non-uniform image, image loss, inconsistent image density and paper crumpling occur.

SUMMARY OF THE INVENTION

Accordingly, it is an aspect of the present invention to provide an apparatus to transfer a color laser printer, wherein a unit to control a position of the central axis of the intermediate transfer belt and a unit to control a position of the central axis of the transfer roller are disposed on a same plane of a printer body frame so that the central axes of the two members can remain parallel to obtain a uniform transfer nip and to obtain a stable image.

Additional aspects and advantages of the invention will be set forth in part in the description which follows and, in part, will be obvious from the description, or may be learned by practice of the invention.

The foregoing and/or other aspects of the present invention may be achieved by providing an apparatus to transfer a color image in a laser printer, including a printer body frame having a side wall; a plurality of guide rollers provided in the printer body frame; an intermediate transfer belt to rotatably travel along a loop by being wound around the guide rollers, and to transfer a color image by a toner; a photosensitive drum to receive the color image from the intermediate transfer belt; a transfer roller to press and contact the intermediate transfer belt with a transfer nip therebetween, and to rotate to transfer the color image of the intermediate transfer belt to a printing paper; a transfer panel, positioned to rotatably open and close with respect to the printer body frame, to support the transfer roller to be rotatable; a separating unit to separate the transfer roller from the intermediate transfer belt at constant intervals or to press the transfer roller to contact the intermediate transfer belt; and an aligning unit to align the transfer roller to maintain an accurate position of the transfer roller with respect to the intermediate transfer belt in the printer body frame.

The aligning unit may include a guide axis being parallel and connected to the transfer roller at predetermined intervals and including a plurality of projection guide portions being projected on sides of the transfer roller.

The central axis of the intermediate transfer belt and the central axis of the transfer roller may be controlled with respect to their positions on the same level of the printer body frame. Thus, the position of the transfer roller with respect to the intermediate transfer belt in the printer body frame can be constantly and uniformly maintained. Specifically, since the degree of freedom in the Y axis direction of the transfer roller is accurately restricted, it is possible to form a uniform transfer nip, thereby ensuring image quality.

The unit to separate/pressurize the transfer roller may include the first and second pressurizing blocks, being supported by the transfer panel, and having a first axis hole in which one side is opened therein to receive and support both ends of the axis of the transfer roller and a second axis hole into which the guide axis is inserted; the first and second separating levers being connected to the first and second pressurizing blocks and being displaced respectively outward relative to the first and second pressurizing blocks, and having ends inserted into the projection guide portion of the guide axis, one of the separating levers forming a cam operation part; the first and second elastic members being provided between each pressurizing block and the transfer panel to elastically support the first and second pressurizing blocks in the direction that the transfer roller is closely contacted against the intermediate transfer belt; and a cam unit including a cam provided on one side wall in the printer body frame to be connected to the cam operation part of the second separating lever and rotating the separating lever in the direction that the transfer roller is separated from the intermediate transfer belt.

The first and second pressurizing blocks and the first and second separating levers may be connected by a hook hole formed in each pressurizing block and a hook formed on each separating lever to be inserted into the hook hole at predetermined movement intervals.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
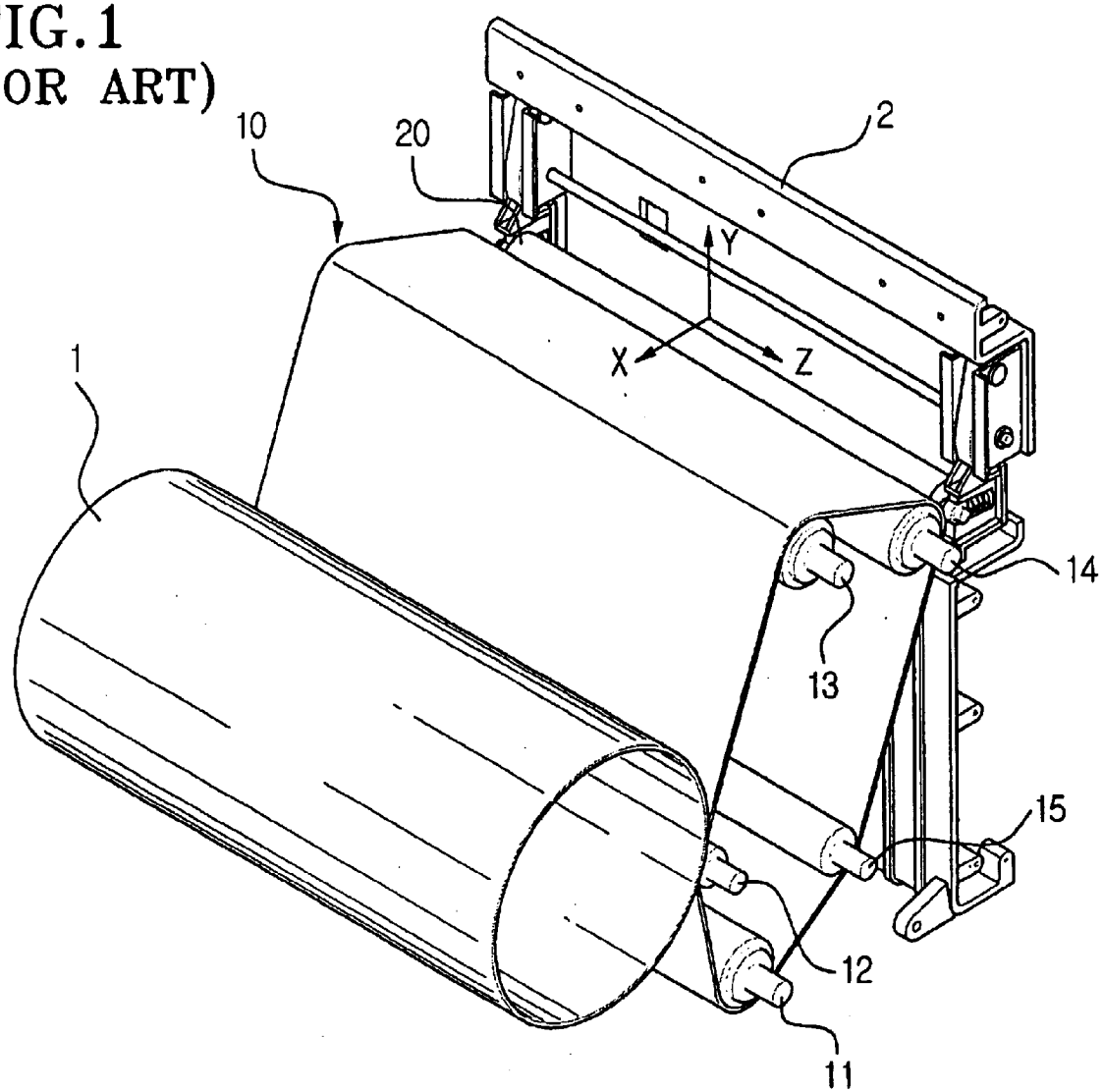
FIG. 1 (PRIOR ART)
FIG. 1 is a perspective view illustrating a conventional transfer apparatus.
Figure 2A:
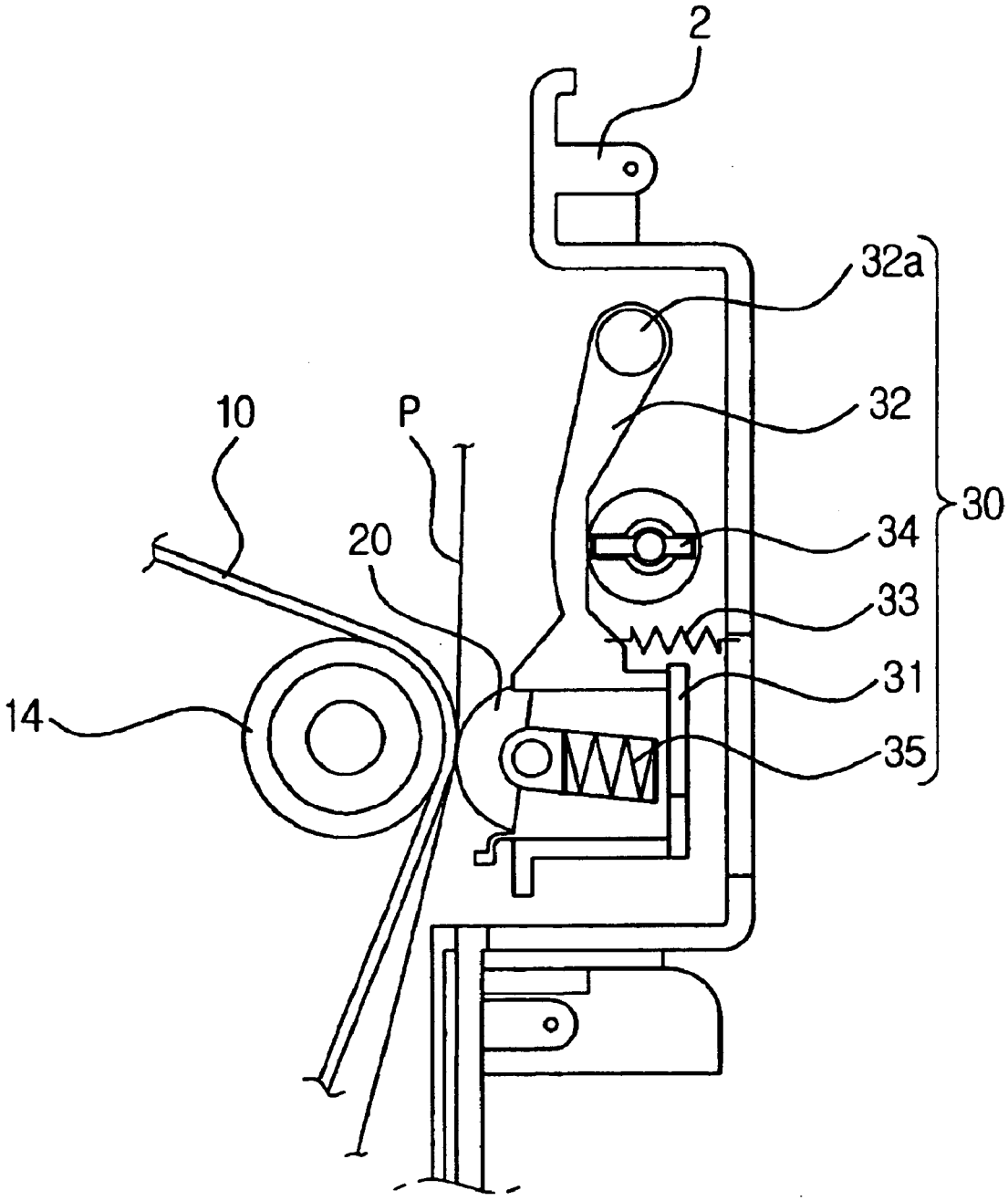
FIG.2A (PRIOR ART)
FIGS. 2A and 2B are sectional views illustrating the separating/pressurizing operation of a transfer roller of the transfer apparatus as shown in FIG. 1.
Figure 2B:
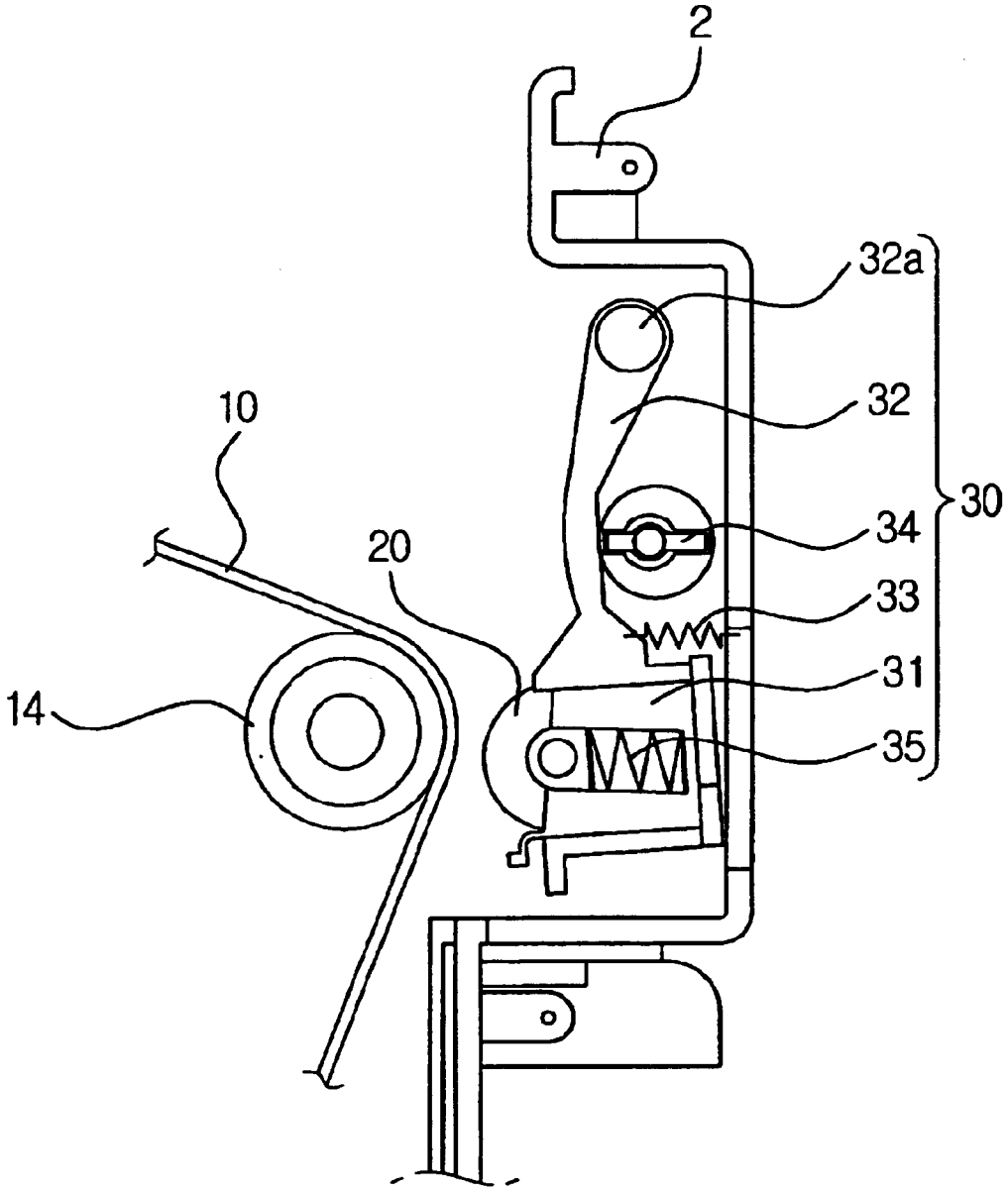
FIG.2B (PRIOR ART)

Reference will now be made in detail to the present preferred embodiment of the present invention, an example of which is illustrated in the accompanying drawings, wherein like reference numerals refer to like elements throughout.

Figure 3:
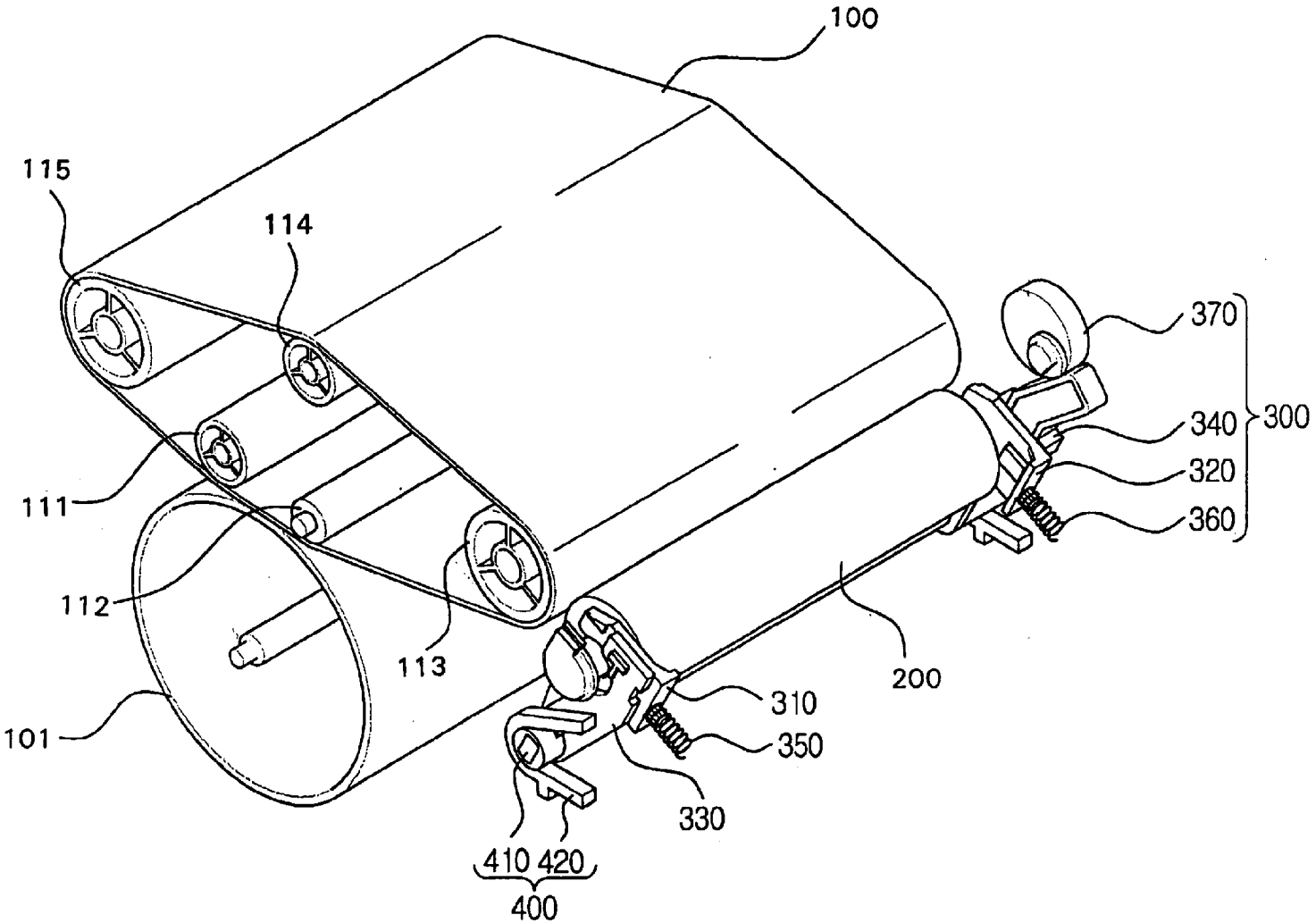
FIG. 3 is a perspective view illustrating a transfer apparatus according to an embodiment of the present invention.
Figure 4A:
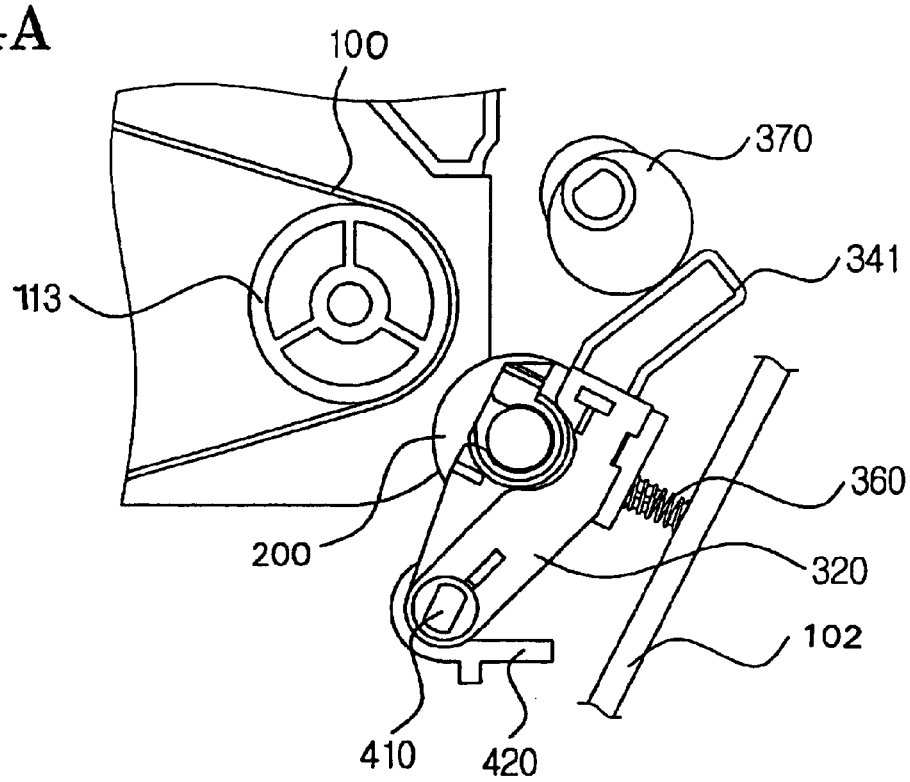
FIGS. 4A and 4B are sectional views illustrating the separating/pressurizing operation of a transfer roller of the transfer apparatus as shown in FIG. 3.
Figure 4B:
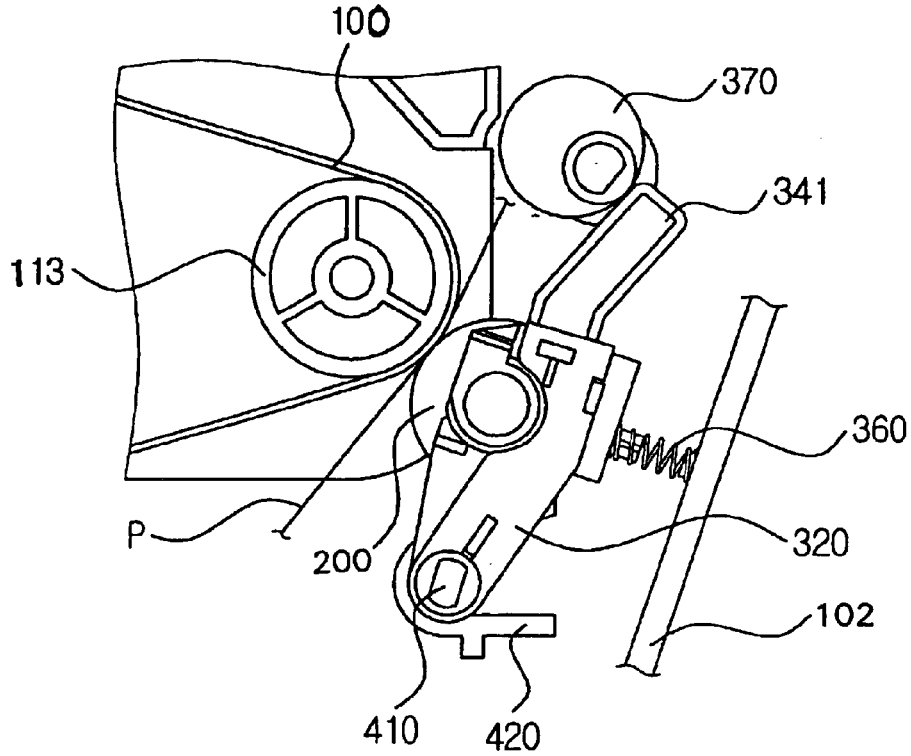

As illustrated in FIGS. 3, 4A and 4B, an apparatus to transfer a color laser printer according to an embodiment of the present invention includes an intermediate transfer belt 100, a transfer roller 200, a transfer roller separating/pressurizing unit 300 and a transfer roller aligning unit 400.

The intermediate transfer belt 100 winds around a plurality of guide rollers 111–115 disposed in a printer body frame (not shown) and is provided to rotatably travel along an endless loop. The intermediate transfer belt 100 is connected to a photosensitive drum 101 as a photosensitive medium by the guide roller photosensitive drum 101 is transferred to the intermediate transfer belt 100.

The transfer roller 200 is disposed to selectively contact the guide roller 113 with the intermediate transfer belt 100 therebetween. Therefore, the toner image transferred to the intermediate transfer belt 100 is transferred to a printing paper P passing between the intermediate transfer belt 100 and the transfer roller 200. Furthermore, the transfer roller 200 is provided on a transfer panel 102 which is capable of pivoting to open and close about the printer body frame. Therefore, when the paper P is jammed in a paper path between the intermediate transfer belt 100 and the transfer roller 200, the jammed paper is easily removed by opening the transfer panel 102 from the printer body frame.

The transfer roller separating/pressurizing unit 300 includes first and second pressurizing blocks 310, 320 to selectively separate or contact the transfer roller 200 and the intermediate transfer belt 100, and to support the transfer roller 200; first and second separating levers 330 and 340; first and second elastic members 350, 360; and a cam 370.

Figure 5:
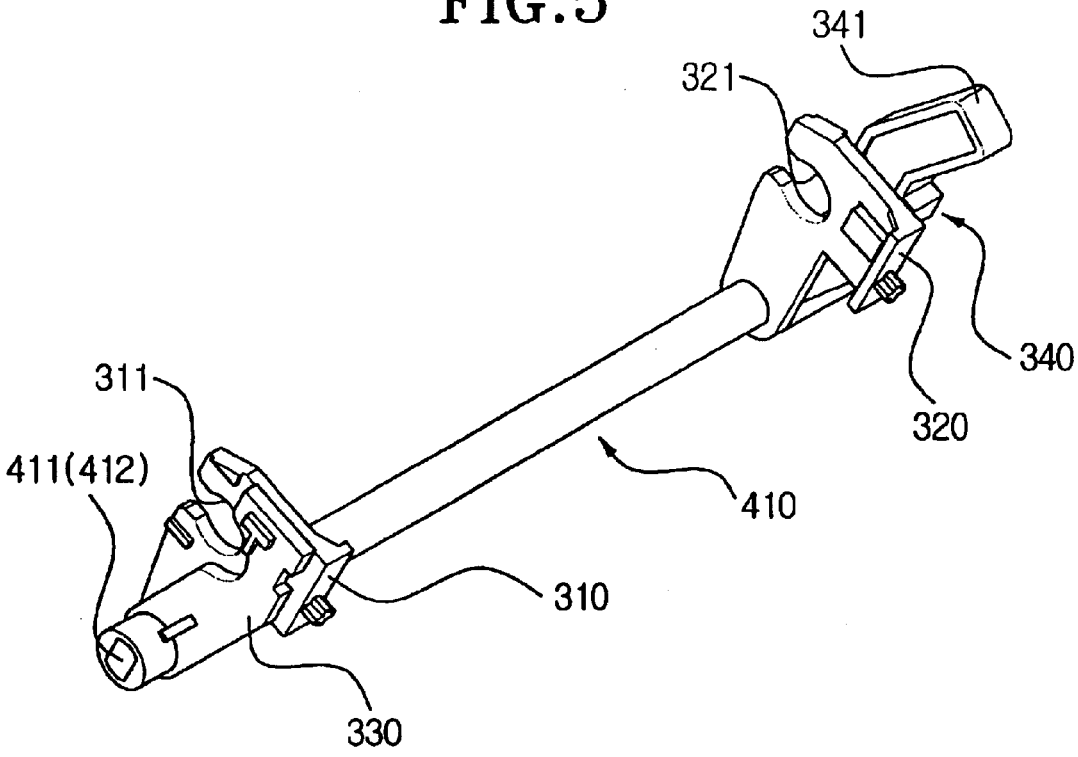
FIG. 5 is a perspective view illustrating a pressurizing block and a separating lever of the transfer apparatus of FIG. 3.
Figure 6:
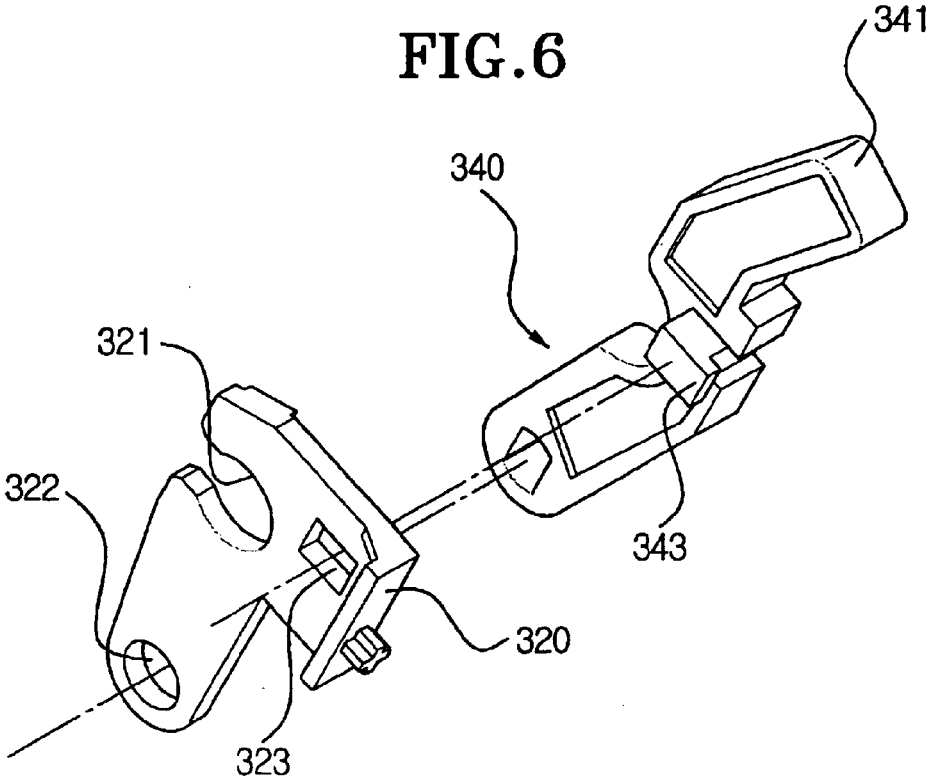
FIG. 6 is a perspective view illustrating the connecting relationship between the pressurizing block and the separating lever as shown in FIG. 5.

As shown in FIGS. 5 and 6, the first and second pressurizing blocks 310, 320 include first axis holes 311, 321 having an open end and to receive and support both ends of an axis of the transfer roller 200. The first and second pressurizing blocks 310, 320 also include a second axis hole 322. The second axis hole 322 receives a guide axis 410 of the transfer roller aligning unit 400 described below.

The first and second separating levers 330, 340 are connected to the first and second pressurizing blocks 310, 320 outward with respect to the first and second pressurizing blocks 310 and 320. The ends of the separating levers 330, 340 are disposed to be inserted into the guide axis 410. Furthermore, in the second separating lever 340, a cam operation part 341 is formed. The cam operation part 341 is connected to the cam 370 described below, and thus the first and second separating levers 330, 340 are rotated around the guide axis 410 as the cam 370 is rotated.

Figure 7:
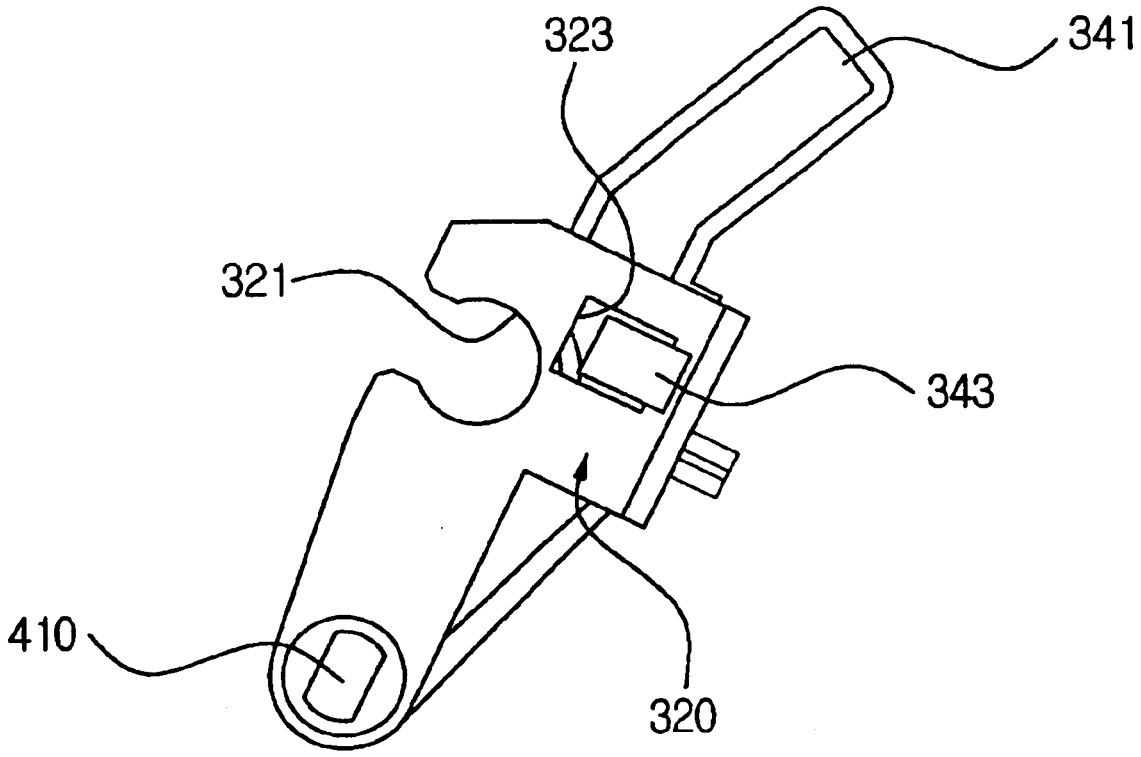
FIG. 7 is a side view of the connecting relationship of FIG. 6.

As illustrated in FIGS. 6 and 7, the first and second separating levers 330, 340 and the first and second pressurizing blocks 310, 320 are connected by a hook hole 323 formed in each of the pressurizing blocks 310, 320 and a hook 343 formed in each of the separating levers 330, 340 to be inserted into the hook hole 323 at predetermined intervals. Therefore, as the first and second separating levers 330, 340 are rotated by the cam 370, the first and the second pressurizing blocks 310, 320 are also rotated in the same direction, thereby the transfer roller 200 can be separated from the intermediate transfer belt 100 at constant intervals, as shown in FIG. 4A.

The first and second elastic members 350, 360 are provided between the first and second pressurizing blocks 310, 320, and the transfer panel 102, so that the transfer roller 200 elastically supports the first and second pressurizing blocks 310, 320 in the direction of being pressurized and tightly in contact against the intermediate transfer belt 100. Thus, the transfer roller 200 closely contacts the intermediate transfer belt 100, as illustrated in FIG. 4B. At this time, since the pressurizing blocks 310, 320 are connected to the first and second separating levers 330, 340 at a predetermined movement clearance by the hook hole 323 and the hook 343, the pressurizing blocks 310, 320 are rotated around the guide axis 410 together with the first and second separating levers 330, 340. On the other hand, in the state in which the transfer roller 200 closely contacts the intermediate transfer belt 100, an independent recovery force is applied to the first and second pressurizing blocks 310, 320 by the first and second elastic members 350, 360, thereby enabling a uniform transfer nip between the transfer roller 200 and the intermediate transfer belt 100.

The cam 370 forms a cam unit to rotate the second separating lever 340 in the direction in which the transfer roller 200 is separated from the intermediate transfer belt 100, and is provided on an inner sidewall of the printer body frame to be connected to the cam operation part 341 of the second separating lever 340. Although not shown, the cam unit requires a unit to drive the cam 370. Although any additional driving source can be used as the driving unit, the power which drives the other parts of the printer can also be used.

The transfer roller aligning unit 400 maintains an accurate position of the transfer roller 200 with respect to the intermediate transfer belt 100 and includes the guide axis 410 and a guide member 420.

The guide axis 410 is connected in a parallel manner to the transfer roller 200 at predetermined intervals and includes projection guide portions 411, 412 being projected on both sides of the transfer roller 200.

The guide member 420 is provided on the inner sidewalls of the printer body frame to receive and support the projection guide portions 411, 412 on both sides of the guide axis 410.

Accordingly, the position of the transfer roller 200 can be uniformly maintained when mounting the transfer panel 102 into the printer body frame after certain actions. For example, the position is maintained after removing the paper jammed between the intermediate transfer belt 100 and the transfer roller 200, which is accomplished by opening the transfer panel 102 from the printer body frame. Since the projection guide portions 411, 412 on both sides of the guide axis 410 are received and supported in the guide member 420 provided in the inner sidewalls of the printer body frame, the position of the transfer roller 200 can be uniformly maintained. Specifically, in a conventional transfer apparatus, position control in the Y axis direction of the transfer roller 20 was unstable. However, in the present invention, since the position control in the Y axis direction of the transfer roller 200 is done with the printer body frame and the intermediate transfer belt 100, any misalignment does not occur.

As described above, in the apparatus to transfer the color laser printer according to the present invention, since the cam 370 drives to rotate the second separating lever 340 counter-clockwise around the guide axis 410 when the toner image on the photosensitive drum 101 is transferred to the intermediate transfer belt 100, as shown in FIG. 4A, the transfer roller 200 and the intermediate transfer belt 100 maintain the separation state at constant intervals.

After the intermediate transfer belt 100 forms an image by making four revolutions, the cam 370 is returned to the original position, as shown in FIG. 4B. Then, the second separating lever 340 is rotated counter-clockwise around the guide axis 410 by a recovery force of the second elastic member 360, and the transfer roller 200 is pressurized and contacted closely to the intermediate transfer belt 100 by a predetermined pressure.

The conventional transfer roller 20, which is selectively separated from and pressurized or contacted closely to the intermediate transfer belt 10, moves with degrees of freedom in the X, Y and Z axis directions, thereby preventing a uniform transfer nip from occurring. In the present embodiment, the degree of freedom in the Z axis direction can be compensated for since the length of the transfer roller 200 is longer than that of the paper. In the present embodiment, the degree of freedom in the X axis direction can be also compensated for by correcting the pressurizing force of the first and second elastic members 350, 360. Furthermore, the degree of freedom in the Y axis direction can be compensated for by the transfer roller aligning unit 400. That is, since the projection guide portions 411, 412 on both sides of the guide axis 410 and disposed parallel to the transfer roller 200 at constant intervals are received and stably supported in the guide member 420 provided in the inner walls of the printer body frame, the degree of freedom in the Y axis direction of the transfer roller 200 is restricted, thereby enabling accurate alignment in the Y axis direction with respect to the intermediate transfer belt 100.

According to the embodiment of the present invention as described above, since it is possible to realize accurate alignment of the transfer roller and the intermediate transfer belt in the transfer process of the color laser printer requiring the separating operation of the transfer roller, a uniform transfer nip is achieved, thereby securing a more stable image quality.

Although an embodiment of the present invention has been shown and described, it will be appreciated by those skilled in the art that changes may be made in these embodiments without departing from the principles and spirit of the invention, the scope of which is defined in the claims and their equivalents.

What is claimed is:

1. An apparatus to transfer a color image in a laser printer, comprising:

a printer body frame having a side wall;

a plurality of guide rollers provided in the printer body frame;

an intermediate transfer belt to rotatably travel along a loop by being wound around the guide rollers, and to transfer the color image by a toner;

a photosensitive drum, the intermediate transfer belt receiving the color image from the photosensitive drum;

a transfer roller to press and contact the intermediate transfer belt with a transfer nip therebetween, and to rotate to transfer the color image of the intermediate transfer belt to a printing paper;

a transfer panel, positioned to rotatably open and close with respect to the printer body frame, to support the transfer roller to be rotatable;

a separating unit to separate the transfer roller from the intermediate transfer belt at constant intervals or to press the transfer roller to contact the intermediate transfer belt; and an aligning unit to align the transfer roller to maintain an accurate position of the transfer roller with respect to the intermediate transfer belt in the printer body frame.

2. The apparatus according to claim 1, wherein the aligning unit comprises:

a guide axis being parallel and connected to the transfer roller at predetermined intervals and including a plurality of projection guide portions being projected on sides of the transfer roller, the side wall inward of the printer body frame to receivably support the projection guide portions of the guide axis.

3. The apparatus according to claim 2, wherein the separating unit comprises:

first and second pressurizing blocks, being supported by the transfer panel, the pressurizing blocks each comprising:

a first axis hole to support the transfer roller and having an open side to receive the transfer roller, and a second axis hole into which the guide axis is inserted;

first and second separating levers, being respectively connected to the first and second pressurizing blocks and extending outward from the first and second pressurizing blocks, the separating levers having ends which are disposed to be engaged to the projection guide portions of the guide axis;

a cam operation part formed at an end of the second separating lever;

first and second elastic members being respectively provided between the first and second pressurizing blocks and the transfer panel to elastically support the first and second pressurizing blocks in a direction in which the transfer roller is pressed against the intermediate transfer belt; and a cam unit to rotate the second separating lever in a direction in which the transfer roller is separated from the intermediate transfer belt, the cam unit including a cam provided in the side wall of the printer body frame to be connected to the cam operation part of the second separating lever.

4. The apparatus according to claim 3, wherein the first and second pressurizing blocks further comprise hook holes formed therein, and the first and second separating levers comprise hooks, and the first and second pressurizing blocks and the first and second separating levers are connected to each other by inserting the hooks into the hook holes.

5. The apparatus according to claim 4, wherein the aligning unit further comprises:

guide members being provided on an inside of the printer body frame to receivably support the projection guide portions of the guide axis.

6. An apparatus to transfer an image to a medium, comprising:

a frame having a side wall;

a belt to receive the image;

a roller to selectively be separate from the belt and selectively press against the belt with a nip formed therebetween, and to transfer the image from the belt to the medium; and an aligning unit, attached to the side wall of the frame, to align the roller relative to the belt when the roller is seperate from the belt and when the roller presses against the belt.

7. An apparatus to transfer an image to a medium, comprising:

a frame having a side wall;

a belt to receive the image;

a roller to press against the belt with a nip formed therebetween, and to transfer the image from the belt to the medium;

an aligning unit, attached to the side wall of the frame, to align the roller relative to the belt; and a moving unit to selectively separate the roller from the belt and press the roller against the belt, the moving unit comprising:

a cam attached to the side wall of the frame, and a lever to move as a result of a rotation of the cam and thereby move the roller from/against the belt, the lever having an end.

8. The apparatus according to claim 7, wherein the aligning unit comprises:

a guide axis connected to the roller and comprising a projection to engage with the end of the lever and thereby receive the movement of the lever; and a guide member, on the side wall of the frame, to support the projection.

9. The apparatus according to claim 8, further comprising:

an opening/closing unit to support the roller and selectively open/close with respect to the frame, wherein an alignment of the roller with respect to the belt is constant between successive closed states of the opening/closing unit.

10. An apparatus to transfer an image to a medium, comprising:

a frame having a side wall;

a belt to receive the image;

a roller to press against the belt with a nip formed therebetween, and to transfer the image from the belt to the medium; and an opening/closing unit to support the roller and selectively open/close with respect to the frame, wherein an alignment of the roller with respect to the belt is maintained during open and closed states of the opening/closing unit.

11. The apparatus according to claim 10, further comprising:

an aligning unit, attached to the side wall of the frame, to align the roller relative to the belt.

12. The apparatus according to claim 11, wherein the aligning unit comprises a substantially linear element bent upon itself to form a V-shaped groove to receive the roller and align the roller relative to the belt.

* * * * *

UNITED STATES PATENT AND TRADEMARK OFFICE

CERTIFICATE OF CORRECTION

PATENT NO. : 6,862,421 B2
DATED : March 1, 2005
INVENTOR(S) : Jae-myoung Choi

It is certified that error appears in the above-identified patent and that said Letters Patent is hereby corrected as shown below:

Column 7,
Line 62, remove the word “inward”.

Column 8,
Line 48, change “seperate” to -- separate --.

Signed and Sealed this

Twenty-ninth Day of November, 2005

JON W. DUDAS
*Director of the United States Patent and Trademark Office*